US006066420A

United States Patent [19]

Ohtsu et al.

[11] Patent Number: 6,066,420

[45] Date of Patent: May 23, 2000

[54] IMAGE FORMING METHOD USING PHOTOVOLTAIC FORCE

[75] Inventors: Shigemi Ohtsu; Satoshi Tatsuura; Lyong Sun Pu, all of Kanagawa, Japan

[73] Assignee: Fuji Xerox Co., Ltd., Tokyo, Japan

[21] Appl. No.: 08/929,673

[22] Filed: Sep. 15, 1997

[30] Foreign Application Priority Data

Sep. 19, 1996 [JP] Japan ..... 8-248228

[51] Int. Cl.[7] ..... G03G 5/024

[52] U.S. Cl. ..... 430/31

[58] Field of Search ..... 250/370.09; 430/31

[56] References Cited

U.S. PATENT DOCUMENTS

| | | | |
|---|---|---|---|
| 3,647,286 | 3/1972 | Delorme | 430/31 |
| 5,172,163 | 12/1992 | Yamaoki et al. | 430/31 |
| 5,821,018 | 10/1998 | Ohtsu et al. | 430/48 |

FOREIGN PATENT DOCUMENTS

| | | |
|---|---|---|
| 2-142835 | 5/1990 | Japan . |
| 7-228318 | 8/1995 | Japan . |
| 10-3139 | 1/1998 | Japan . |
| 10-3233 | 1/1998 | Japan . |

OTHER PUBLICATIONS

"Electroconductive Polymers" by S. Yoshimura (Polymers Society of Japan, 1987).

"Functions and Designs of Electroconductive Organic Films" by K. Yamashita and H. Kitani (Surface Science Society of Japan, pp. 89–107, (1988).

"Fundamentals and Applications of Electroconductive Polymers" by K. Yoshino (I.P.C., 1988).

"J. Chem. Soc., Chem. Commun., p. 87, (1986)" by H. Shinohara et al.

"J. Chem. Soc., of Japan, No. 3, p. 465 (1986)" by H. Shinohara et al.

"Practical Technologies of Organic Semiconductors" Published by Science Forum, Published on Oct. 30, 1993 (1st Edition, 1st Printing).

*Primary Examiner*—John Goodrow

*Attorney, Agent, or Firm*—Oliff & Berridge, PLC

[57] ABSTRACT

A medium (for example, a solution) containing a dye is in contact with an image forming material in which a PN junction or a PIN junction is formed on the substrate. When the image forming material is irradiated with light, the PN junction or the PIN junction generates an electromotive force, whereby the dye is deposited on the portion where the electromotive force is generated to form an image.

20 Claims, 6 Drawing Sheets

IMAGE FORMING METHOD USING PHOTOVOLTAIC FORCE

BACKGROUND OF THE INVENTION

1. Field of the Invention

This invention relates to an image forming method in which at least a dye is moved to and deposited on an electromotive force-generated portion by electromotive force produced by irradiating with light. This invention also relates to an image forming material used in this method.

2. Description of the Related Art

Methods for transferring an image to an unspecialized recording medium such as paper or the like from an electric signal or optical signal, which are currently utilized in a printer or the like, are exemplified by a dot-impact method, thermal transfer method, thermal sublimation method, ink jet method, and laser printing method in electrophotographic methods. These methods are roughly divided into three groups.

In methods of a first group including dot-impact, thermal transfer, and thermal sublimation methods, a sheet such as an ink ribbon, donor film, or the like, which is provided with dispersed dye molecules, is superposed on paper or the like and the dye molecule is transferred to the paper or the like by a mechanical impact or heat. These methods always require expendable supplies and are low in energy efficiency, resulting in high running costs. Also, in these methods except for the thermal sublimation method, the quality of image is poor.

In the ink jet method of the second group, ink is directly transferred to paper from a head and hence no expendable supply except for ink is required, resulting in low running costs. In this ink jet method, however, the minimal image unit is determined by the size and interval of the heads and hence the printing speed decreases with an increase in printing quality. Also, this ink jet method is not very energy efficient.

In the third group, electrophotographic methods using laser printers or the like are exemplified. In these methods, an image is formed via an intermediate transferring member. Specifically, a toner is adsorbed onto an electrostatic latent image formed on a light-sensitive member through a laser spot. This is transferred to paper to form an image. Because of this, it is possible to form a comparatively fine image. Also, only a toner is consumed, resulting in low running costs. There are, however, problems in that this method requires high voltage for the formation of an electrostatic latent image and for the adhesion and transfer of a toner, resulting in high power consumption and the generation of ozone and nitrogen oxides.

Furthermore, there is the problem that operational sounds are large in all of the above printing methods.

On the other hand, an ordinary printing method, silver salt photographic method, and the like are known as image forming methods in which no printer is used. In these methods, an image of high quality can be formed. The ordinary printing method using a printing plate formed for printing is low in running costs when forming a large number of identical images. However, it is unsuitable for general uses. Also, the silver salt photographic method requires the use of a medium such as a photographic film, photographic printing paper, or the like, which is not reusable, resulting in high running costs. Also, in this method, a specific developing process is required and hence real-time printing can not be expected.

As above-mentioned, among the image forming methods currently used, there is no method which forms an image of high quality, is low in running costs, has features of energy and resource savings, does not generate noise and harmful substances, and specifically there is no method which is harmless to both the environment and to users.

SUMMARY OF THE INVENTION

This invention has been achieved in view of this situation and has a first object of providing an image forming method provided with the above-mentioned features. Namely, formation of an image of high quality, high speed printing, low running costs, excellent energy and resource savings, and zero noise and harmful substance generation.

A second object of the present invention is to provide an image forming material suitable for the image forming method having the above features.

The present inventors directed their attention to the behavior of an ionic dye molecule in a thin layer of an electroconductive polymer, electrodeposition of an ionic dye molecule, and the like and investigated these phenomena to complete the invention. The above first object can be attained in the present invention by the provision of an image forming method comprising:

- a step of preparing an image forming material provided with a substrate and a PN junction or a PIN junction formed on the surface of the substrate; and
- a step of irradiating the image forming material with light to generate electromotive force, by which an image forming agent containing at least a dye is transferred to and deposited on the portion, where the electromotive force is generated, to form an image.

The above first object can also be attained by a preferred embodiment of the image forming method of the present invention comprising:

- a preparative step of preparing an image forming material provided with a substrate having an electroconductive surface and a PN junction or a PIN junction formed on the electroconductive surface; and
- a step of bringing a medium (for example, a solution) including a precursor of an image forming agent containing at least a dye (for example, an ionized dye and a precursor of an electroconductive polymer or only an ionized dye) into contact with the image forming material and irradiating the image forming material with light to generate electromotive force causing the generation of a photoelectric chemical reaction in which the precursor of the image forming agent participates and to produce an image forming agent (for example, an electroconductive polymer into which the dye is incorporated or only a non-ionized dye) from the precursor of image forming material, whereby the image forming agent is deposited on the portion of the image forming material, where the electromotive force is generated.

In short, in the above invention, the image forming material provided with the PN or the PIN junction is allowed to generate an electromotive force by irradiating the image forming material with light to form an image on the portion where the electromotive force is generated. Typically, a thin layer of the electroconductive polymer, into which the dye is incorporated, is deposited on the electromotive force-generated portion to form an image, or the pH in the vicinity of the electromotive force-generated portion is varied to make use of differences in solubility of the dye according to variations in pH and thereby to form an electrodeposition layer of the dye on the electromotive force-generated portion as an image.

FIG. 1 shows a typical view of an embodiment of the image forming method of the present invention to facilitate the understanding of the principal of the present invention. As shown in FIG. 1, an image forming material 10 is provided with a PIN junction consisting of an n-type semiconductor layer 1N, an insulating layer 1I, and p-type semiconductor layer 1P, which are formed on a substrate 11. A medium 13 containing a dye 12 contacts the image forming material 10. The image forming material 10 is irradiated with light to move electrons and positive holes and thereby to generate electromotive force. The dye 12 is deposited on the portion where the electromotive force is generated to form an image.

An electroconductive polymer layer which can be utilized in the present invention has been examined with regard to its use in the protective film of a battery or a solar battery, electrochromatic displays, or the like by making use of its functions in which the film is doped or dedoped with a low molecular ion corresponding to its oxidative, neutral, or reducing condition, which is associated with chromatic variations. However, no method has been proposed in which an electrochemical reaction between a dye having a comparatively large molecular weight and an electroconductive polymer is utilized for producing recording materials or in image forming methods. The present inventors perceived this fact and have applied for patents on the invention in which an electroconductive polymer doped or dedoped reversibly with a dye by an electrochemical reaction is produced and utilized for recording materials or transfer methods and on the invention in which an electrodeposition layer of a dye is produced by an electrochemical reaction without using an electroconductive polymer and utilized for recording materials or in transfer methods (see Japanese Patent Application Nos. 7-228318 (filed on Sep. 5, 1995), 8-98727 (filed on Apr. 19, 1996), and 8-92857 (filed on Apr. 15, 1996), and the like). Among these, a method is proposed in which an electromotive force generated by irradiation with light is utilized to induce an electrochemical reaction when forming an image. In this case, a Schottky barrier is formed between an n-type semiconductor or a p-type semiconductor and a solution and the Schottky barrier is irradiated with light to form an electromotive force.

However, in the present invention, not a Schottky junction but a PN junction or a PIN junction which is used for an electromotive force generating device assembled in a photodetector or a solar battery is utilized to generate photovoltaic force by irradiation with light. When the PN or PIN junction is compared with the Schottky junction, the PN or PIN junction has the advantage that the resulting electromotive force is larger and, as a result, the voltage to be externally applied is further reduced and it is unnecessary to apply bias voltage depending on the material to be selected. Also, because the PIN junction is utilized as a photodetector, the PIN junction is higher in photosensitivity and has improved image contrast.

The above first object can be also attained by a second image forming method of the present invention comprising the steps of:

preparing an image forming material provided with a substrate and a PN junction or a PIN junction formed on the surface of the substrate, wherein an image forming agent containing at least a dye is deposited on the surface of the junction; and irradiating the image forming material with light to generate electromotive force, by which the image forming agent is released from the portion, where the electromotive force is generated, to form an image.

The above first object can be also attained by a preferred embodiment of the second image forming method of the present invention comprising the steps of:

preparing an image forming material provided with a substrate having an electroconductive surface and a PN junction or a PIN junction formed on the electroconductive surface of the substrate, wherein an image forming agent containing at least a dye is deposited on the surface of the junction; and irradiating the image forming material with light to generate electromotive force and bringing a medium, into which at least the dye can be incorporated, into contact with the image forming material, to induce a photoelectrochemical reaction in which the image forming agent participates, whereby the image forming agent is released from the portion, where the electromotive force is generated, to form an image.

In a word, in the above invention, the image forming material is allowed to generate an electromotive force by irradiating the image forming material with light to release the image forming agent such as a dye from the portion where the electromotive force is generated and thereby to form an image.

In the first and second image forming methods of the present invention, a pixel size can be reduced in size because a pixel is formed of a dye. Therefore, a high degree of resolution is expected in these methods. Also, the incorporation and releasing (delivery) of the image forming agent such as a dye can be realized with comparatively low energy. High voltage, complicated machines, and the like are not required, thereby achieving a reduction in running costs and energy and resource savings. Also, noise and harmful substances are not generated.

An image formed by the first image forming method of the present invention can be transferred to other media (transfer media) and the image forming agent released in the second image forming method of the present invention can be transferred to a transfer medium.

The image forming material which can be used in the present invention has a simple structure and is inexpensive.

BRIEF DESCRIPTION OF THE DRAWINGS

In the accompanying drawings, there are shown illustrative embodiments of the invention from which the objectives, novel features, and advantages will be readily apparent.

In the drawings.

DESCRIPTION OF THE PREFERRED EMBODIMENTS

Figure 1:
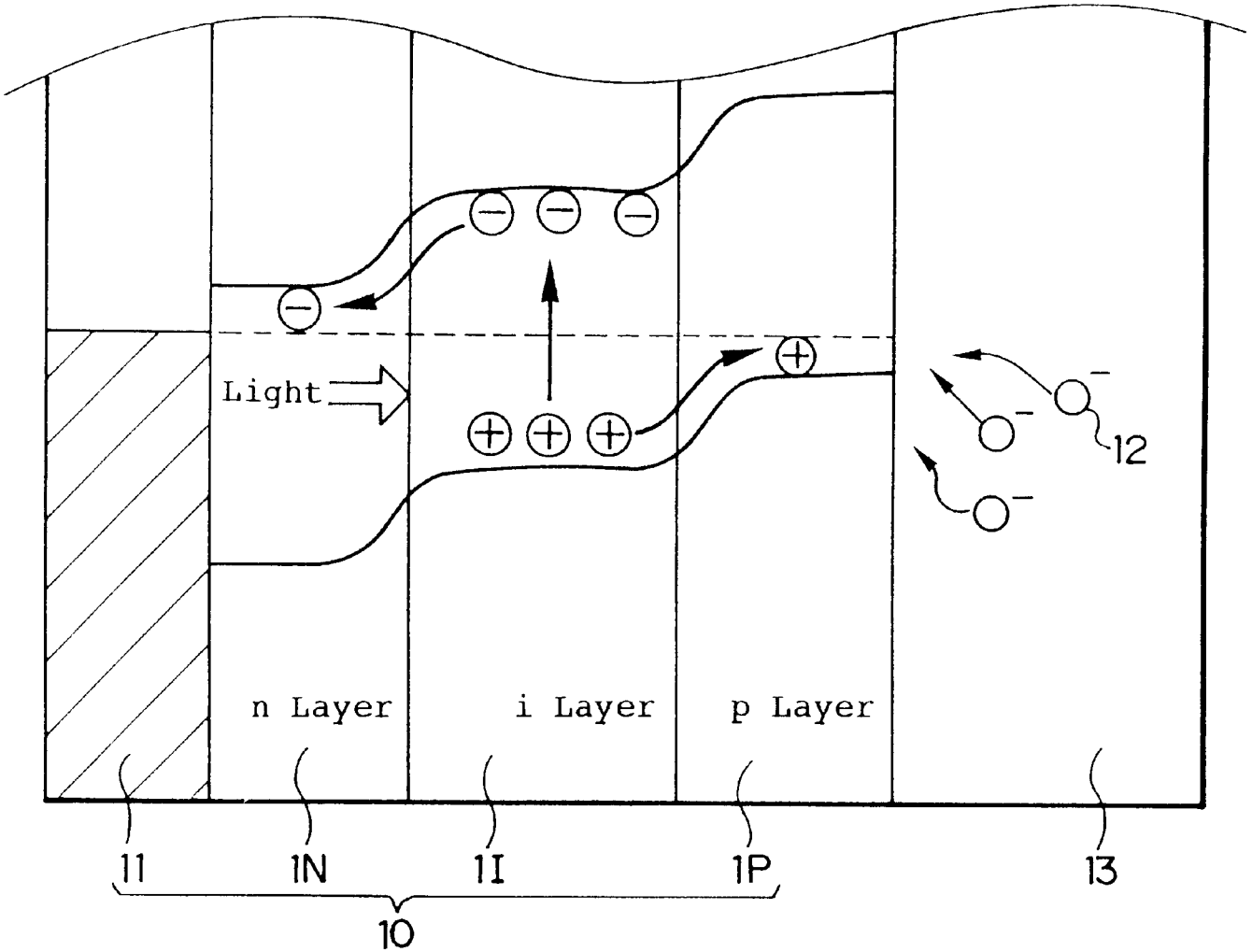
FIG. 1 is a schematic view showing the principle embodiments of the image forming method of the present invention.

The image forming method and image forming material of the present invention will now be explained in detail by way of typical embodiments.

In such an image forming method, first, an image forming material comprising a substrate provided with an electroconductive surface and a PN junction or a PIN junction formed on the electroconductive surface is prepared.

The substrate may be one, either entire or only the surface of which is formed of an electroconductive material and may be formed of an optional material if the electroconductive portion can be well connected with the PN or PIN junction electrically.

As the material used for the electroconductive portion, for example, a transparent electroconductive film such as tin oxide, ITO, or the like or a film of a metal such as Au, Pt, Ag, Ni, or the like can be adopted. However, a transparent electroconductive layer is desirably used when incident light is introduced from the reverse face.

As a material used for the substrate other than the electroconductive portion, glass, a plastic film, a metal, or the like can be used. Materials used for the PN or PIN junction are optional as long as the material has a structure in which a p-type semiconductor is conjugated with an n-type semiconductor either directly or via an insulating layer and is a photoconductive material which has a capability of generating photovoltaic force. These materials may be organic or inorganic. Typical examples of the material used for the inorganic semiconductor include Si, Ge, GaAs, CdSe, CdS, CdTe, InP, AlSb, GaP, and the like. Also, not only a monocrystal, but an amorphous crystal may be utilized.

Whether these semiconductors are n-type or p-type depends on the characteristics of the above materials, the kind of dopant with which the material is doped, and the like. These details are familiar to persons skilled in the art.

As the organic photoconductive material, materials containing various central metals can be utilized. Examples include phthalocyanines, porphyrines, naphthalocyanines (p-type), perylene, perylene derivatives (n-type), perylenetetracarboxylic acid diimide, benzimidazoleperylene and the like, polyvinylcarbazole [PVK] (p-type), quinacridones (p-type), polyphnylenevinylene [ppv] (n-type), and the like. As combinations of the PN junction, copper phthalocyanine (p-type)/perylenetetracarboxylic acid diimide (n-type) or benzimidazoleperylene (n-type) is exemplified and is photosensitive to visible light so that it is optically writable using a He—Ne laser. A combination of titanylphthalocyanine and benzimidazoleperylene is preferable in the use of an infrared semiconductor laser.

A non-doped semiconductor is generally used as the insulating layer. This insulating layer has the function of creating a carrier. When an organic photoconductive material is used, the boundary of a PN junction fills this function since the PN junction is a heterojunction.

In general, any material having sensitivity to the light from the light source used for writing in the succeeding step may be used as the material for the PN or PIN junction which is utilized in the present invention. The material used for the PN or PIN junction is determined based on a combination with the light source. When it is desired to prepare a large image forming area using a semiconductor laser as a light source, the use of a PIN junction formed of amorphous silicon or an organic semiconductor PN junction is advantageous.

In the case of a PIN junction formed of amorphous silicon, the thicknesses of n-type amorphous silicon, i-type amorphous silicon, and p-type silicon are preferably from 10 to 50 nm, from 500 to 1,000 nm, and from 10 to 50 nm respectively. In the case of an organic PN junction, it is desirable that the thicknesses of a P layer and N layer be both from 20 to 100 nm because of low electroconductivity and large absorption.

Figure 2:
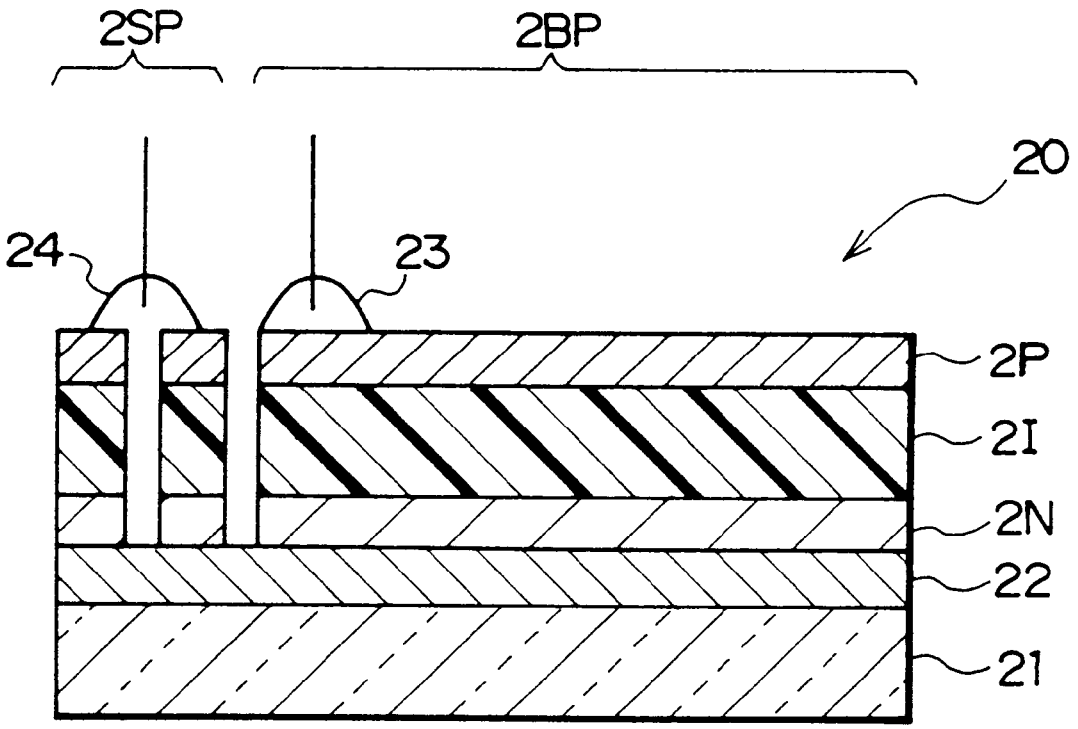
FIG. 2 is a schematic view showing an embodiment of an image forming material provided with a PIN junction.

FIG. 2 shows a schematic sectional view of an embodiment of an image forming material provided with a PIN junction. An image forming material 20 has a structure in which a transparent electroconductive layer 22 is disposed on a glass substrate 21 and an n-type semiconductor 2N, an insulating layer 2I, and a p-type semiconductor 2P are laminated in this order on the transparent electroconductive layer 22. Also, Al terminal 23 is formed by vapor deposition to facilitate electrical connections with the p-type semiconductor 2P of a body portion 2BP. Further, in order to facilitate electrical connections with the n-type semiconductor 2N of a body portion 2PB, Al terminal 24 is formed by vapor deposition so as to reach the transparent electroconductive layer 22 of a separate portion 2SP via a hole of the separate portion 2SP separated from the body portion 2PB.

Needless to say, the above terminals 23, 24 are not required if they are not needed to conduct with the n-type semiconductor 2N and with the p-type semiconductor 2P.

Figure 3:
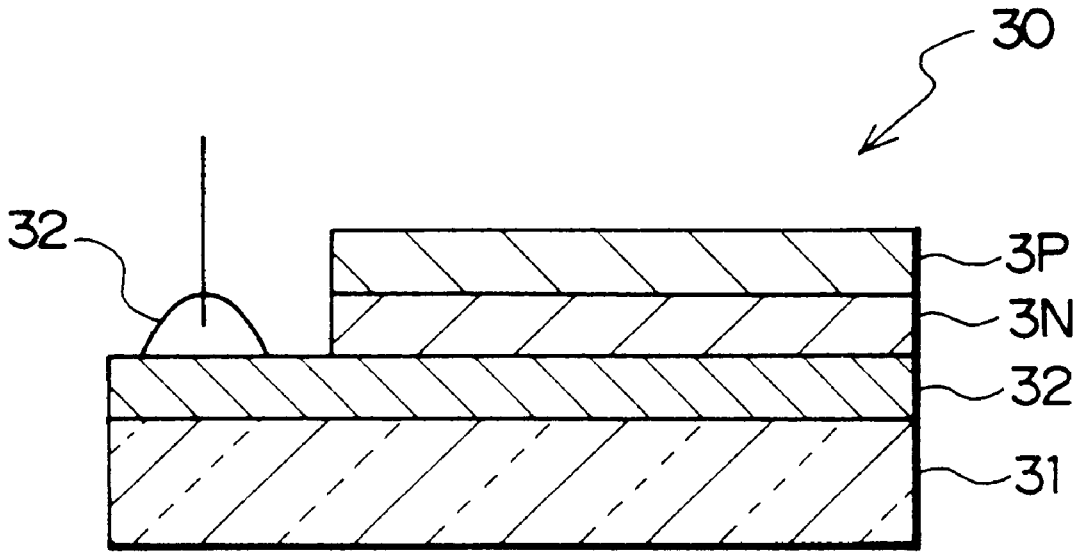
FIG. 3 is a schematic view showing an embodiment of an image forming material provided with a PN junction.

FIG. 3 shows a schematic sectional view of an embodiment of an image forming material provided with a PN junction. An image forming material 30 has a structure in which a transparent electroconductive layer 32 is disposed on a glass substrate 31 and an n-type semiconductor 3N and a p-type semiconductor 3P are laminated in this order on almost all of the transparent electroconductive layer 32. Also, in order to facilitate electrical connection with the n-type semiconductor 3N, Al terminal 33 is formed by vapor deposition on the transparent electroconductive layer 32 where it is not covered by the semiconductor.

In the embodiments shown in FIGS. 2 and 3, the n-type semiconductor, the insulating layer, and the p-type semiconductor (in FIG. 2), or the n-type semiconductor and the p-type semiconductor (in FIG. 3) are respectively laminated in this order from the side close to the substrate. However, the n-type semiconductor and the p-type semiconductor are inversely placed corresponding to the electric properties (anionic or cationic) of a dye (explained below in detail) contained in a precursor of image forming agent used in a step of forming an image.

Next, in the image forming method according to the present invention, a medium including a precursor of the image forming agent containing at least a dye is brought into contact with the image forming material and the image forming material is irradiated with light to generate electromotive force. In this manner, an image forming agent is produced from the precursor of the image forming agent by a photo-electrochemical reaction due to the above electromotive force and is deposited on the portion where the electromotive force is generated to form an image (image forming step).

The phrase "a precursor of the image forming agent containing at least a dye" means a compound including, as an essential component, a dye which has not yet formed an image and, as required, other components which help the dyes to form an image or precursors of these components; and being capable of constituting an image forming agent (that is, a material including a dye and, as required, other components which help the dye to form an image) which has actual constituents forming the image by the chemical and/or physical change.

The precursor of the image forming agent is exemplified by a material (i) including a dye and a precursor of an electroconductive polymer and a material (ii) including substantially only a dye.

As the precursor of electroconductive polymer in the former material (i), any material can be used if the material is converted to an electroconductive polymer and aids doping or dedoping with an ionic dye by electrochemical oxidation or reduction in the step of the above conversion or in the succeeding step. Examples of the precursor of electroconductive polymers of the material (i) include various unidimensional electroconductive polymer such as a polyacetylene type, polydiacetylene type, polyheptadiene type, polypyrrole type, polythiophene type, polyaniline type, polyphenylenevinylene type, polythiophenylenevinylene type, polyisothianephtene type, polyisonaphthothiophene type, polyparaphenylene type, polyphenylene sulfide type, polyphenylene oxide type, polyfuran type, polyphenanthrene type, polyselenophene type, polytellurophene type, polyazulene type, polyindene type, polyindole type, polyphthalocyanine type, polyacene type, polyacenoacene type, polynaphthylene type, polyanthracene type, polyperinaphthalene type, polybiphenylene type, polypyridinopyridine type, polycyanediene type, polyallenemethanoid type; compounds called "ladder polymer" or "pyropolymer", and precursors (monomer or prepolymer) of two-dimensional type electroconductive polymer such as graphite.

Among these, polypyrrole and polythiophene are particularly preferable since these compounds can reduce driving potential.

The dye used in the former material (i) can be selected from arbitrary ionic dye molecules. Given as examples of the dye are synthetic dyes such as acridine type, azaphthalide type, azine type, azulenium type, azo type, azomethine type, aniline type, amidinium type, alizarin type, anthraquinone type, isoindolinone type, indigo type, indigoid type, indoaniline type, indolylphthalide type, oxazine type, carotinoide type, xanthin type, quinacridone type, quinazoline type, quinophthalone type, quinoline type, quinone type, guanidine type, chrome chelate type, chlorophyll type, ketone imine type, diazo type, cyanine type, dioxazine type, dis-azo type, diphenylmethane type, diphenylamine type, squalirium type, spiropyran type, thiazine type, thioindigo type, thiopyrylium type, thiofluoran type, triallylmethane type, trisazotriphenylmethane type, triphenylmethane type, triphenylmethane phthalide type, naphthalocyanine type, naphthoquinone type, naphthol type, nitroso type, bisazoxadiazole type, bisazo type, bisazostilbene type, bisazohydroxyperinone type, bisazofluorenone type, bisphenol type, bislactone type, pyrazolone type, phenoxazine type, phenothiazine type, phthalocyanine type, fluoran type, fluorene type, fulgide type, perynone type, perylene type, benzimidazolone type, benzpyran type, polymethine type, porphyrin type, methine type, merocyanine type, monoazo type, leucoauramine type, leucoxanthene type, rhodamine type, and the like; and natural dyes such as a turmeric, gardenia, piprica, vermillion malted rice, lac, grape, beet, perilla, berry, corn, cabbage, cacao, and the like. In this case, it is necessary to select an appropriate dye from these dyes depending on the characteristics of the polymer, conditions of the medium and the like used in the process, solubility of the dye molecule, and the like.

The above precursor of electroconductive polymer is converted into an electroconductive polymer layer, into which an ionic dye is incorporated when the precursor is electrochemically polymerized, in the presence of the above-described dye ions and ions having the characteristics and molecular weight equivalent to the above dye ions, as coexisting ions. The electroconductive polymer layer polymerized in this manner can be doped or dedoped with ionic dye molecules in a larger amount more reversibly through electrochemical oxidation or reduction compared with those produced in the presence of other ions having a smaller molecular weight. Accordingly, the electroconductive polymer layer produced from the polymer precursor can be electrochemically controlled with respect to an oxidized, neutral, or reduced condition, whereby the polymer layer is reversibly doped or dedoped with ions (ions of an anionic or cationic dye molecule).

Incidentally, the details of the electroconductive polymer layer are described, for example, in "Electroconductive Polymers" by S. Yoshimura (Polymers Society of Japan, 1987), "Functions and Designs of Electroconductive Organic Films" by K. Yamashita and H. Kitani (Surface Science Society of Japan, pp. 89–107, 1988) and "Fundamentals and Applications of Electroconductive Polymers" by K. Yoshino (I.P.C., 1988). Also, the details of the reversible doping and dedoping ions with a small molecular weight of not more than 150 in the electroconductive polymer are disclosed in "J. Chem. Soc., Chem. Commun., p87, (1986)" by H. Shinohara et al. and "J. Chem. Soc., of Japan, No. 3, p465 (1986)" by H. Shinohara et al., and the like. However, in these reports, there are no disclosures of the reversible doping and dedoping of the electroconductive polymer with dye having a comparatively high molecular weight and the image formation utilizing a dye and an electroconductive polymer layer. Other than the above, a method for utilizing an electroconductive polymer layer as a material relating to marking is described in Japanese Patent Application Laid-Open (JP-A) No. 2-142835 entitled "METHOD FOR CONTROLLING WETTABILITY OF SURFACE OF POLYMER THIN LAYER, IMAGE FORMING METHOD USING THE SAME, AND IMAGE FORMING MATERIAL". This method, however, is directed to a technology for forming a printing plate by electrically switching to different wettability corresponding to an oxidized and neutral condition and has no relation to the technology for the incorporation of a dye. Therefore, in this method, amounts of absorption and transfer of a dye (ink) cannot be controlled.

The latter precursor (ii) of image forming agent, in which substantially only a dye is included, may be a dye which can be electrodeposited. As the dye, dyes can be utilized, which are different in solubility in a medium, particularly in an aqueous solution, relating to pH and is deposited from a medium or incorporated into the medium by dissolution or the like corresponding to pH. Any sort of dye may be used, especially, if it can be dissolved in an aqueous solution in either acidic, neutral, or alkaline conditions and then made unsoluble by altering the conditions so that it is deposited on the image forming material. For example, an anionic dye molecule which deposits from an aqueous solution under acidic conditions or cationic dye molecule which deposits from an aqueous solution under alkaline conditions can be used.

More concretely, color formers, called "precursors of the dye", which exhibit a coloring structure under external stimulation from acids, alkalis, and the like ("dye" described in the present invention is defined by a concept including these color formers). Typical examples of these color formers are a triphenylmethane phthalide type, phenoxazine type, phenothiazine type, fluoran type, indolyl phthalide type, spiropyran type, azaphthalide type, diphenylmethane type, chromenopyrazol type, leucoauramine type, azomethine type, Rhodamine lactam type, naphtholactam type, and a triazene type.

Also, molecules which are produced by combining one more of a carboxyl group (—COOH), amino group (—$NH_2$), or azomethine group (>C=N—) with a pigment or dye used as a coloring source to acquire solubility in water, and repeat deposition and dissolution reversibly through the oxidation-reduction of the carboxyl group or the amino group can be adopted. Typical examples of the molecules include rose bengale, erythrocin, methylene blue, oxazine type cation pure blue 5GH, and the like. Incidentally, even if the molecule contains other substituents, it is principally usable when it has prescribed characteristics. There are no limitations to the kinds of functional group to be combined.

The aforementioned "medium including a precursor of the image forming agent" is an optional medium which can hold the precursor of the image forming agent through dissolution, dispersion, or the like of the precursor of the image forming agent and can release it from the medium when the precursor of the image forming agent is changed from the precursor of the image forming agent to the image forming agent. The medium is generally a solution, especially a solution capable of dissolving the precursor of the image forming agent.

Specifically, water, an aqueous organic solvent such as alcohol or the like, or a mixture of these may be used as the medium.

The wavelength of light which allows the image forming material to generate electromotive force is, as mentioned above, selected depending on the properties of the PN or PIN junction. The wavelength to be used can be easily selected by persons skilled in the art.

Use of laser beams is desirable in that images can be formed easily and with a high degree of resolution. In this case, the power necessary depends on the sort and size of the image forming material. However it may be, in the range of from about 1 mW to 10 mW.

The image forming material is generally allowed to function as one electrode, and in addition to preparing a counter electrode, and the image forming material and the counter electrode are either brought into contact with the above medium or are immersed into the medium to facilitate a photo-electrochemical reaction by the above electromotive force to thereby form an image.

Specifically, an image forming process can be carried out in an apparatus shown in FIGS. 4 to 7, which is usually used for electrochemical processing. The image forming materials shown in these figures are an embodiment in which an n-type semiconductor, insulating layer, and p-type semiconductor or an n-type semiconductor and p-type semiconductor are laminated in this order on a substrate. Irradiation with light causes an image forming agent to be produced from a precursor of the image forming agent containing an anionic dye. The image forming agent is deposited as an image on the p-type semiconductor of the image forming material.

Figure 4:
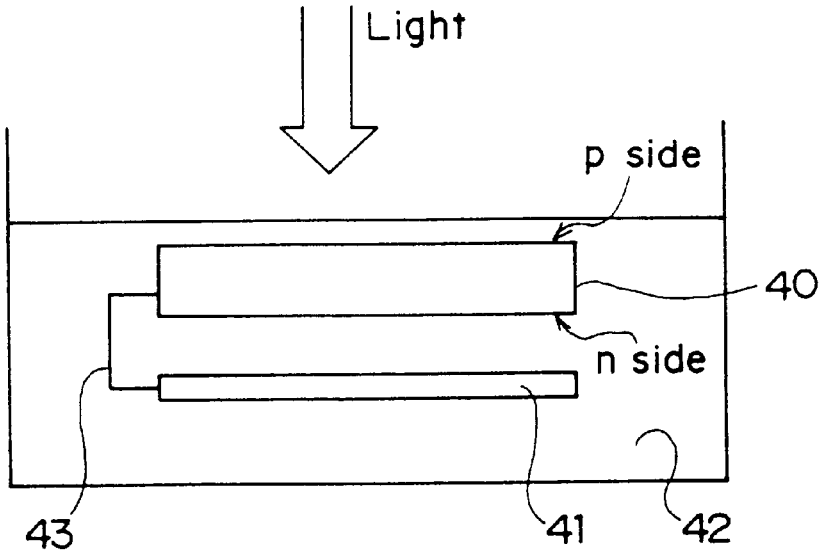
FIG. 4 is a schematic view showing an embodiment of an apparatus for practicing the image forming method of the present invention.

In the apparatus shown in FIG. 4, an image forming material 40 arranged so that the side of the p-type semiconductor faces a light source and a Pt electrode 41 are immersed in an aqueous solution (medium) 42 containing the above precursor of the image forming agent. Also, the side of the n-type semiconductor of the image forming material 40 is connected to the Pt electrode 41 by a conductive wire 43.

Figure 5:
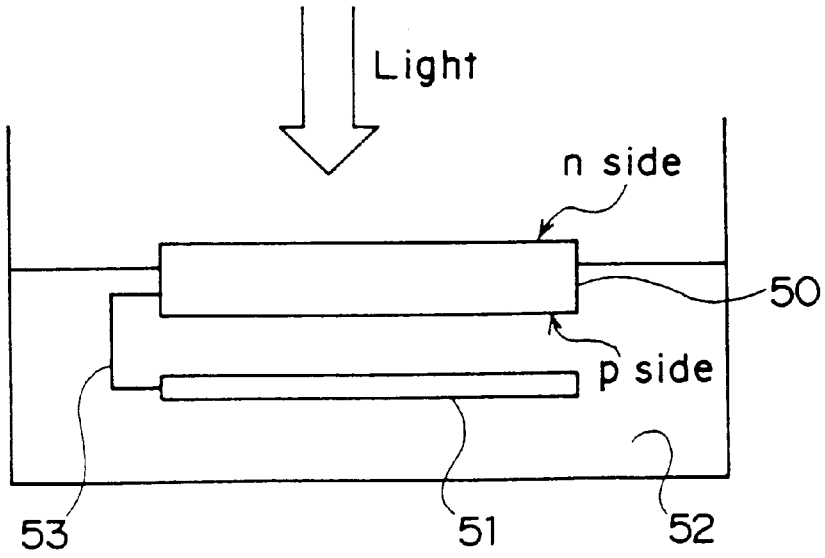
FIG. 5 is a schematic view showing another embodiment of an apparatus for practicing the image forming method of the present invention.

In the apparatus shown in FIG. 5, an image forming material 50 arranged so that the side of the n-type semiconductor faces a light source through a substrate provided with a transparent electroconductive layer and a Pt electrode 51 are immersed in an aqueous solution (medium) 52 containing the above precursor of the image forming agent. Also, the side of the n-type semiconductor of the image forming material 50 is connected to the Pt electrode 51 by a conductive wire.

Figure 6:
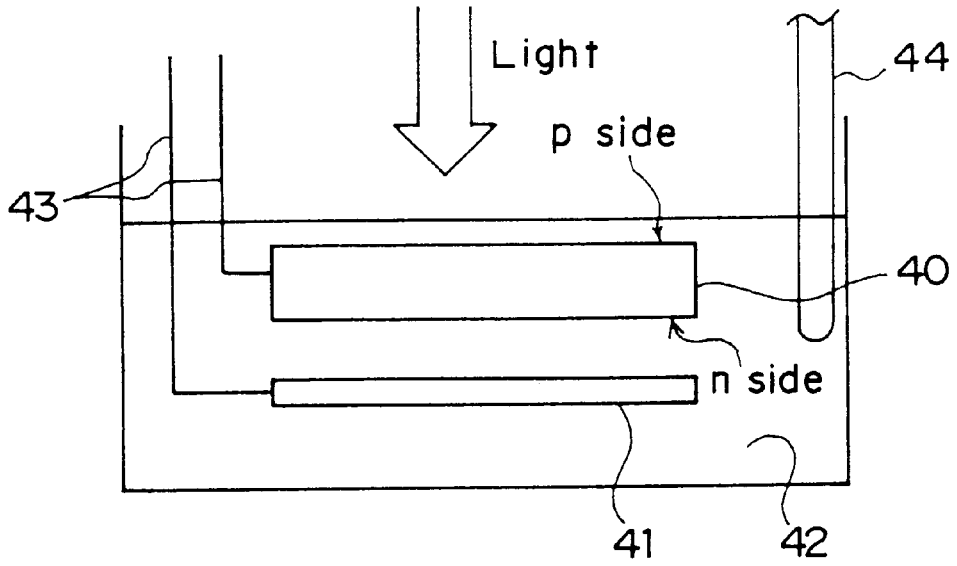
FIG. 6 is a schematic view showing a further embodiment of an apparatus for practicing the image forming method of the present invention.

The apparatus shown in FIG. 6 has the same structure as that of the apparatus shown in FIG. 4 except that the side of an n-type semiconductor of an image forming material is not directly connected with a Pt electrode but connected with the Pt electrode via a bias voltage applying means (not shown) and a saturated calomel electrode 44 is used.

Figure 7:
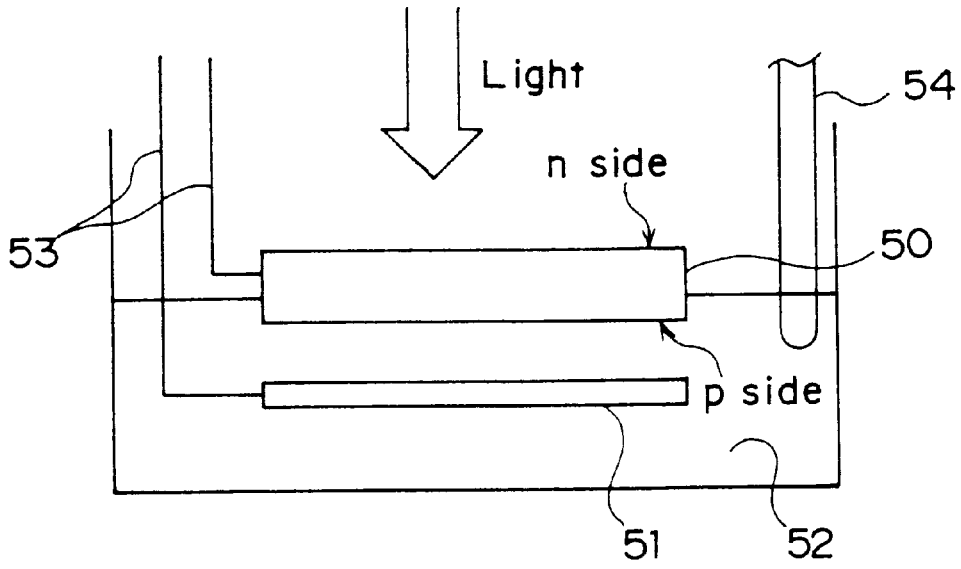
FIG. 7 is a schematic view showing still a further embodiment of an apparatus for practicing the image forming method of the present invention.

The apparatus shown in FIG. 7 has the same structure as that of the apparatus shown in FIG. 5 except that the side of an n-type semiconductor of an image forming material is not directly connected with a Pt electrode but connected with the Pt electrode via a bias voltage applying means (not shown) and a saturated calomel electrode 54 is used.

In the apparatus shown in FIG. 4, an image is formed on the image forming material in the following manner. As the precursor of the image forming agent, a material composed, for example, of an anionic dye and a precursor of an electroconductive polymer is used. First, a desired portion of the image forming material 40 is irradiated with light such as laser light. Electromotive force (for example, 0.6 V) is generated there and the side of the p-type semiconductor is charged positively, whereby an electrochemical reaction is induced. Then, the precursor of the electroconductive polymer incorporates the anionic dye while it is deposited as an electroconductive polymer to form an image on the surface of the p-type semiconductor at the portion where the electromotive force is generated.

Incidentally, when an electroconductive polymer is doped with an anionic dye, an n-type semiconductor was irradiated with light in previous patent applications by the present inventors and others since a Schottky barrier was used. However, in the present invention in which a PN or PIN junction is utilized, an electroconductive polymer layer is formed on the surface of a p-type semiconductor (this is inverted in the case where a cationic dye is doped).

Also in the apparatus shown in FIG. 5, an image is formed on the surface of the p-type semiconductor of the image forming material 50 substantially in the same manner as in the above embodiment. However, in this embodiment light can be irradiated from the back face of the substrate so that the wavelength of light absorbed by the dye can be used. The choices of wavelength utilized as the light source are wider, which is of advantageous in recording color or black images.

Also, in the apparatuses shown in FIGS. 6 and 7, an image is formed on the surface of the p-type semiconductor of the image forming material 40 or 50 substantially in the same manner as in the above embodiment. However, in these apparatuses, other than the electromotive force generated by light, a desired bias voltage can be applied to the image forming material 40 or 50 by the bias voltage applying means. For example, if bias voltage is applied in advance to supply a slightly positive charge to the side of the p-type semiconductor, the sum of the voltage by the electromotive force and the bias voltage is applied to the p-type semiconductor by light irradiation. Accordingly, this bias voltage can be efficiently utilized in the case where relatively high voltage is required to deposit the precursor of the image forming agent as an image forming agent on the surface of the p-type semiconductor. In view of these points, it is advantageous to form an image by the apparatuses shown in FIGS. 6 and 7 when utilizing the precursor of the image forming agent composed substantially only of a dye, though an image can be formed by the apparatuses shown in FIGS. 4 and 5.

When a precursor of the image forming agent composed substantially only of an anionic dye is used, an image is mainly formed in the following manner. Namely, when the image forming material is irradiated with light, the pH of the medium (solution) in the vicinity of the portion where the electromotive force is generated is changed to that in an acid range and an electrodeposited layer of the dye is formed as an image on the portion, where the electromotive force is generated, due to differences in the solubility of the anionic dye corresponding to variations in pH (the dye deposits in an acid range)

In the image forming method of the present invention, it is possible to form a desired image by light scanning. Also, when forming an image, the amount of charge flow in the image forming material can be controlled by controlling one or more of the intensity of light to be applied, the period of time of irradiation, and the bias voltage to be applied, so that the image capable of gradation depiction can be obtained. The gradation of an image can be also improved by varying the concentration and the like of the image forming agent, particularly the dye in the medium. The image density can be controlled step-wise and continuously in this manner.

A dye of only a desired portion can be released (dedoping) from the image recording material on which an image is formed as described above. This will become clear from the descriptions of the transfer steps given below. After that, the dye can be doped and electrodeposited again in the above methods utilizing irradiation with light or the like.

The above explanations is mainly for the image formation using an anionic dye. However, if an image forming material is used in which a p-type semiconductor, insulating layer, and n-type semiconductor or a p-type semiconductor and n-type semiconductor are laminated in this order (the reverse order to the above case) on a substrate, an image is formed from a precursor of the image forming agent containing a cationic dye on the n-type semiconductor of the image forming material by irradiation with light according to the above principle (reverse electrically). Specifically, in the case where a precursor of the image forming agent composed substantially only of a cationic dye is used, an image is formed in the following manner. Specifically, when the image forming material is irradiated with light, the pH of the medium (solution) in the vicinity of the portion where the electromotive force is generated becomes alkaline and an electrodeposited layer of the dye is formed as an image on the n-type surface at the portion, where the electromotive force is generated, due to differences in the solubility of the cationic dye with variations in pH (the dye deposits under alkaline conditions).

In the above methods, light irradiation is utilized to deposit the image forming agent first on the image forming material. However, the present invention is not limited to such a case as is illustrated below.

If the apparatuses shown in the figures are utilized, an image forming agent is deposited on the image forming material by an electrochemical reaction only by applying a voltage of a predetermined value or more to the image forming material without light irradiation. After that, the dye is released (dedoping) partially or entirely from the image forming material as required (see the transfer step described below). Then, if a desired portion of the image forming material is irradiated with light, the image forming agent can be deposited only on the irradiated portion (while a bias voltage is applied to the image forming material as required).

The actual operation of these steps can be easily practiced by persons skilled in the art who have read the instructions based on FIGS. 2 to 7.

The image formed on the image forming material in the present invention can be transferred to other mediums (transfer medium).

For realizing this, it is desirable to utilize a method of carrying out the transferring process without energizing the image forming material. It is because the method usually used in the electrochemical field, in which the reverse of the voltage for doping and electrodeposition with a dye is applied is generally used only with difficulty since a PN or PIN junction of a semiconductor is utilized in the present invention. The transferring method is typically exemplified by a method of utilizing ion exchange and a method of making use of differences in the solubility of a dye corresponding to variations in pH.

The former method is utilized particularly in the case where the image forming agent is composed of an electroconductive polymer and a dye and the latter method is particularly preferable in the case where the image forming agent is substantially composed only of a dye. Taking these cases, the transferring method will be explained.

In the method of utilizing ion exchange, a transfer medium containing ions having the same polarity as that of the ionic dye kept in the electroconductive polymer layer formed on the image forming material is brought into contact with the electroconductive polymer layer.

Explaining the functions of the transfer medium, an ionic dye is transferred to the transfer medium and the image formed on the transfer medium by the dye is viewed. Therefore, materials used for the transfer medium are required to possess these functions. Examples of the materials used as the transfer medium are hydrophilic materials such as paper, woven fabric, non-woven fabric, and the like. These materials are usually coated or impregnated with a hydrolytic solution.

Materials utilized for the ion contained in the transfer medium and having the same polarity as that of the ionic dye kept in the electroconductive polymer layer has preferably higher affinity with the electroconductive polymer than with the transfer medium.

When the electroconductive polymer layer holds the anionic dye, the ion in the transfer medium is $OH^-$ and hence it is preferable to keep the pH of the transfer medium at 7 or more. On the other hand, when the electroconductive polymer layer holds the cationic dye, the ion in the transfer medium is $H^+$ and hence it is preferable to keep the pH of the transfer medium at 7 or less.

By the above-mentioned contact, the ionic dye held by the electroconductive polymer layer is exchanged for the ion in the transfer medium, whereby an image pattern of the ionic dye can be formed on the transfer medium.

For example, when the transfer medium containing an anionic $OH^-$ ion is brought into contact with the electroconductive polymer layer formed on the electroconductive substrate and holding the anionic dye molecule, ion exchange between the $OH^-$ ion and the ionized anionic dye molecule takes place. On the other hand, when the transfer medium containing a cationic $H^+$ ion is brought into contact with the electroconductive polymer layer formed on the electroconductive substrate and holding the cationic dye molecule, ion exchange between the $H^+$ ion and the ionized cationic dye molecule takes place.

The ion exchange can be carried out smoothly by appropriately selecting the composition (for example, the electrolytic solution, the ion to be exchanged for the dye molecule, and the like) and pH of the transfer medium corresponding to the sort of ion of the ionic dye held in the electroconductive polymer layer. For example, a polypyrrole thin layer containing rose bengale exhibits no specific change in a neutral buffer solution (pH of 7) or in a acidic buffer solution (pH of 4.5 to 7), but, in an alkaline buffer solution, exhibits the phenomenon in which a rose bengale ion is ion-exchanged for a $OH^-$ ion and then flows outward from the polypyrrole layer.

Partial transfer can be realized, for example, in a method of interposing a mask with a desired pattern between the image forming material and the transfer medium.

The method of utilizing the differences in solubility of a dye corresponding to variations in pH is explained taking the case where a dye which is water soluble under reduced conditions and insoluble when oxidized is transferred to the transfer medium. The face of the image forming material, on which the image of the dye is formed is brought into intimate contact with the transfer medium exhibiting alkalinity. A preferable concrete method involves, the face being brought into contact with the transfer medium coated or impregnated with an aqueous alkaline solution with a pH of from 10 to 12. As a result, the dye molecule is reduced with the increase in pH so that it is again water soluble and diffuses into the transfer medium.

Though the transfer medium utilized at this time only needs the dye molecule receiving capability, it is desirable to use a transfer medium which is coated or impregnated with an aqueous solution of a pH of a fixed value or with an electrolytic solution with a predetermined electroconductivity as described above. Paper, woven fabric, non-woven fabric, or the like may be used as the transfer medium. A buffer solution which is adjusted to have a prescribed pH value is preferably used as the aqueous solution with a fixed pH value, although there are no limitations to the aqueous solution. Also, as the transfer medium, a solid electrolyte, which has a dye receiving capability and a prescribed pH or electroconductivity and is capable of transferring a dye may be used. In this case, improvement in resolution is expected since smudges and the like can be prevented. Examples of materials used for such a solid electrolyte are metals, ceramics, and these with a porous surface, plastics, polymer films, and the like.

If, for example, a transparent polymer film or transparent solid electrolyte is used as the transfer medium, a color filter or a color OHP sheet can be readily produced.

The above explanations pertain to a dye which dissolves in water when reduced and is insoluble when oxidized. In opposition to this, in the case of a dye which dissolves when oxidized but not when reduced, the face of the image forming material, on which the image of the dye is formed is brought into intimate contact with the transfer medium exhibiting acidity, usually a pH of from 2 to 5.

Also, an image forming method differing from the above methods can be used. For example, a dye which deposits in an aqueous neutral solution and dissolves only in an weak aqueous alkaline (or weak acidic) solution is used to form an image. In this case, a transfer medium exhibiting stronger alkalinity (acidity) than the original pH in an aqueous neutral solution without applying voltage, and preferably a transfer medium containing a solution having such properties may be brought into intimate contact with the image forming material to transfer an image of dye.

In the above manner, the transfer of an image can be practiced.

Next, an embodiment of a method in which an image can be continuously formed on the image forming material and transferred to the transfer medium will be explained.

Figure 8:
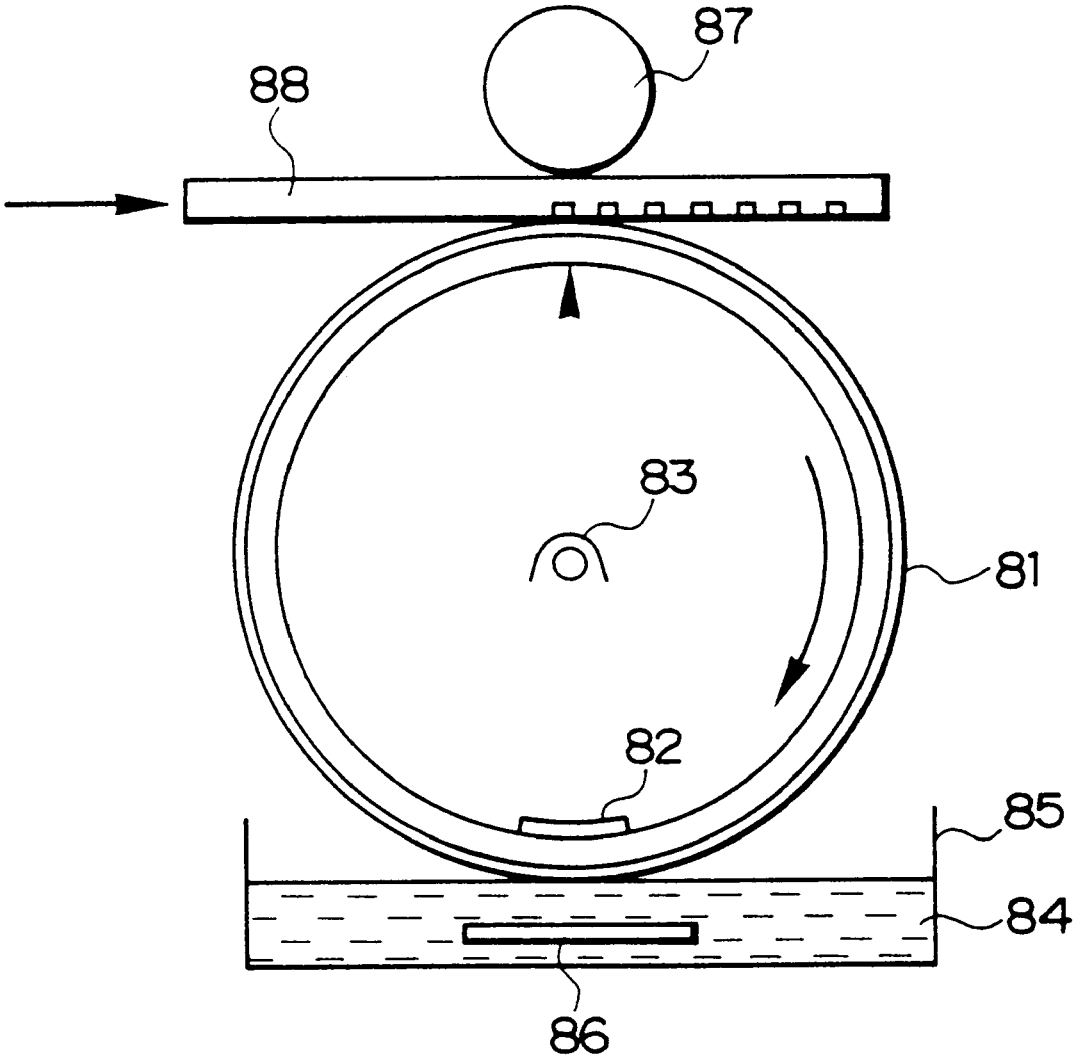
FIG. 8 is a schematic view showing an embodiment of an apparatus which can realize continuous formation of an image on an image forming material and continuous transfer to the transfer medium.

FIG. 8 is a schematic view of an apparatus for this purpose. In FIG. 8, a matrix-type image forming electrode 82 (bias voltage can be independently applied to each matrix) for electrodeposition with an ionic dye is disposed on the inner lower section of a cylinder 81, on the surface of which a PIN junction is formed. Also, a light source 83 is provided in the inner central section. A reservoir 85 for holding a dye electrolytic solution 84 in which an ionic dye molecule is dissolved is disposed at the lower portion of the cylinder 81. A counter electrode 86 facing an image forming electrode 82 is disposed in the reservoir 85. A roll 87 is disposed at a predetermined interval from the surface of the cylinder 81. The transfer paper 88 can pass between the cylinder 81 and the roll 87.

In this image forming apparatus, the PIN junction on the cylinder 81 receives the light from the light source while it receives bias voltage from a predetermined matrix of the matrix-type image forming electrode 82. Only the portion receiving the bias voltage is electrodeposited with a dye, whereby an image is formed. This is brought about by the combined actions of the bias voltage and electromotive force. As the cylinder 81 rotates, an image portion makes contact with the transfer paper 88 having an adjusted pH, and the image is transferred to the transfer paper 88.

In light of the above teachings relating to FIG. 8, persons skilled in the art can easily use various applications and modifications including continuous image formation and transfer in the case of using the image forming agent composed of an electroconductive polymer and a dye, formation of a patterned image by applying bias voltage to the entire image forming electrode in the apparatus in which a means capable of scanning light is built in the cylinder.

Next, the second image forming method of the present invention will be explained.

In the above-described first image forming method, the image forming agent containing the dye is deposited on the image forming material as an image by irradiation with light. The second image forming method of the present invention comprises an image forming agent containing at least a dye released (dedoping) from an image forming material upon light irradiation.

In a typical embodiment of the second image forming method, an image forming material having a substrate provided with an electroconductive surface and a PN or PIN junction on the surface of the substrate are prepared, wherein an image forming agent containing at least a dye is deposited on the junction surface of the image forming material.

The image forming material utilized in the present embodiment is substantially the same as that utilized in the first embodiment. However, a compound in which the image forming material containing at least a dye (the same as that used in the first image forming method) has already been deposited on the surface of the junction is used. Also, materials used as the image forming material are those in which an anionic dye is deposited on the surface of the substrate in the case of an image forming material in which a p-type semiconductor, insulating layer, and n-type semiconductor or a p-type semiconductor and n-type semiconductor are laminated in these orders; and those in which a cationic dye is deposited on the surface of the substrate in the case of an image forming material in which an n-type semiconductor, insulating layer, and a p-type semiconductor or an n-type semiconductor and a p-type semiconductor are laminated in these orders. Specifically, the orders of the p-type semiconductor and n-type semiconductor and the charges of the ions in the image forming material are the reverse of those in the image forming material of the first image forming method. When the first image forming method is applied to the image forming material of the present embodiment, in which the image forming agent can be deposited on the surface of the substrate in the above manner, the electric characteristics of the dye to be deposited is reverse and hence the transfer of the dye can not be realized. In this case, however, if a large bias voltage is applied, the dye is extended over a barrier and deposited on the entire substrate. Further, the deposition of the image forming agent in this case can be realized, for example, by a method of dissolving the image forming agent and drying, as in vapor deposition (which makes no use of an electric action), spin coating, dip coating, or the like.

Next, the image forming material on which the image forming agent is deposited is irradiated with light to generate electromotive force and a medium into which at least a dye can be incorporated is brought into contact with the image forming material. Here, as the medium into which at least a dye can be incorporated, materials similar to those used in the above-mentioned precedent embodiments (for example, solutions) are preferably used.

If, for example, an image forming material, in which an n-type semiconductor, insulating layer, a p-type semiconductor are laminated in this order and a dye to be cationic is deposited on the side of the p-type semiconductor, is used, the side of the p-type semiconductor is positively charged by the irradiation with light and the contact with the medium and the dye is resultantly deposited on the same portion, whereby the dye which can be cationic is released from the surface of the p-type semiconductor due to electrical repulsion. Accordingly, an image can be formed from the remaining image forming agent deposited on the portion not irradiated with light.

There is the difference between this second image forming method and the first image forming method in the release or deposition of dye through light irradiation. However, the technologies explained in the first image forming method can be applied easily to the second image forming method.

EXAMPLES

The present invention will be explained in more detail by way of examples, which do not limit the present invention.

Example 1

As shown in FIG. 2, an n-type a-Si with a thickness of 50 nm, an i-type a-Si with a thickness of 600 nm, and a p-type a-Si with a thickness of 20 nm were laminated in this order on borosilicate glass, on which a transparent electroconductive layer of $SnO_2$ was formed by vapor deposition to prepare an image forming material.

Using the apparatus shown in FIG. 6, and usually used in the electrochemical field, this image forming material having a PIN structure was immersed in an aqueous solution containing 0.06 M of pyrrole and 0.02 M of rose bengale. In the solution, the $SnO_2$ layer of the image forming material was utilized as a working electrode to a saturated calomel electrode. Holding the potential of the working electrode at 0 V, 3 mW He—Ne laser beams were applied for 10 seconds to obtain a polypyrrole thin layer containing rose bengale on the p-Si surface of the image forming material.

The image forming material coated with this pyrrole thin layer was brought into contact with paper containing an alkaline solution of pH 10 and as a result rose bengale was released (dedoping) and transferred to the paper.

Example 2 a-Si was formed on a transparent electroconductive layer of $SnO_2$ in the same manner as in Example 1 to prepare an image forming material having a PIN junction. Next, as shown in FIG. 4, the $SnO_2$ layer of the image forming material was connected with a platinum electrode to prepare a sample. The sample was immersed in a solution containing 0.06 M of pyrrole and 0.02 M of rose bengale. 3 mW He—Ne laser beams were applied for 10 seconds to obtain a polypyrrole thin layer containing rose bengale at the portion irradiated with light (laser beams). From these results, it was confirmed that an image can be formed without applying bias voltage. The image forming material coated with this pyrrole thin layer was brought into contact with paper containing an alkaline solution of pH 10 and as a result rose bengale was released (dedoping) and transferred to the paper.

At this time, the image density (ID) was 1.6.

Example 3 a-Si was formed on a transparent electroconductive layer of $SnO_2$ in the same manner as in Example 1 to prepare an image forming material having a PIN junction. At this time, as shown in FIG. 5, 3 mW He—Ne laser beams were applied for 10 seconds so that incident light was introduced from the side of the transparent electroconductive layer not passing through the solution, to obtain a polypyrrole thin layer containing rose bengale at the portion irradiated with light (laser beams) without applying voltage.

This image forming material coated with this pyrrole thin layer was brought into contact with paper containing an alkaline solution of pH 10 and as a result rose bengale was released (dedoping) and transferred to the paper.

Example 4 a-Si was formed on a transparent electroconductive film of $SnO_2$ in the same manner as in Example 1 to prepare an image forming material having a PIN junction. Using an apparatus shown in FIG. 6, usually used in the electrochemical field, this image forming material having a PIN structure was immersed in an aqueous solution containing only 0.02 M of rose bengale. In the solution, the $SnO_2$ layer of the image forming material was utilized as a working electrode to a saturated calomel electrode. Holding the potential of the working electrode at 0.7 V, 3 mW He—Ne laser beams were applied for 10 seconds to obtain an electrodeposited thin layer, through the deposition of rose bengale on the surface of the p-Si of the image forming material.

The image forming material coated with this electrodeposited thin layer was brought into contact with paper containing an alkaline solution of pH 10 and as a result rose bengale was dissolved and transferred to the paper.

Example 5 a-Si was formed on a transparent electroconductive layer of $SnO_2$ in the same manner as in Example 1 to prepare an image forming material having a PIN junction. At this time, as shown in FIG. 7, incident light was introduced from the side of the transparent electroconductive layer, but not passing through the solution. The image forming material having a PIN structure was immersed in an aqueous solution containing only 0.02 M of rose bengale. In the solution, the $SnO_2$ layer of the image forming material was utilized as a working electrode to a saturated calomel electrode. Holding the potential of the working electrode at 0.7 V, 3 mW He—Ne laser beams were applied for 10 seconds to obtain an electrodeposited thin layer, through the deposition of rose bengale on the surface of the p-Si of the image forming material.

The image forming material coated with this electrodeposited thin layer was brought into contact with paper containing an alkaline solution of pH 10 and as a result rose bengale was dissolved and transferred to the paper.

Example 6

Benzimidazoleperylene (perylene derivative) with a thickness of 50 nm and copper phthalocyanine with a thickness of 50 nm were laminated in this order on a borosilicate glass, on which a transparent electroconductive layer (ITO) was formed, to prepare an image forming material having an organic PN junction shown in FIG. 3. Using an apparatus shown in FIG. 6, which was usually used in the electrochemical field, this image forming material having a PN structure was immersed in an aqueous solution containing 0.06 M of pyrrole and 0.02 M of rose bengale. In the solution, the transparent electroconductive layer (ITO film) of the image forming material was utilized as a working electrode to a saturated calomel electrode. Holding the potential of the working electrode at 0 V, 3 mW He—Ne laser beams were applied for 10 seconds to obtain a polypyrrole thin layer containing rose bengale on the surface of copper phthalocyanine.

Example 7

Using an image forming material in which an organic PN junction was formed on a transparent electroconductive layer substrate in the same manner as in Example 6, the transparent electroconductive layer electrode was connected with a platinum electrode to prepare a sample as shown in FIG. 4. The sample was immersed in a solution containing 0.06 M of pyrrole and 0.02 M of rose bengale. 3 mW He—Ne laser beams were applied for 10 seconds to obtain a polypyrrole thin layer containing rose bengale at the portion irradiated with light (laser beams).

The image forming material coated with this pyrrole thin layer was brought into contact with paper containing an alkaline solution of pH 10 and as a result rose bengale was released (dedoping) and transferred to the paper.

Example 8

An organic PN junction was formed on a transparent electroconductive layer in the same manner as in Example 6 to prepare an image forming material. At this time, as shown in FIG. 5, 3 mW He—Ne laser beams were applied for 10 seconds so that incident light was introduced from the side of the transparent electroconductive layer, not passing through the solution, to obtain a polypyrrole thin layer containing rose bengale at the portion irradiated with light (laser beams) without applying voltage.

The image forming material coated with this pyrrole thin layer was brought into contact with paper containing an alkaline solution of pH 10 and as a result rose bengale was released (dedoping) and transferred to the paper.

Example 9

An organic PN junction was formed on a transparent electroconductive layer in the same manner as in Example 6 to prepare an image forming material. Using an apparatus shown in FIG. 6, usually used in the electrochemical field, this image forming material having a PN structure was immersed in an aqueous solution containing only 0.02 M of rose bengale. In the solution, the transparent electroconductive layer (ITO film) was utilized as a working electrode to a saturated calomel electrode. Holding the potential of the working electrode at 0.7 V, 3 mW He—Ne laser beams were applied for 10 seconds to obtain an electrodeposited thin layer, through the deposition of rose bengale on the surface of copper phthalocyanine.

The image forming material coated with this electrodeposited thin layer was brought into contact with paper containing an alkaline solution of pH 10 and as a result rose bengale was dissolved and transferred to the paper.

Example 10

An organic PN junction was formed on a transparent electroconductive layer in the same manner as in Example 6 to prepare an image forming material. At this time, as shown in FIG. 7, incident light was introduced from the side of the transparent electroconductive layer. The light did not pass through the solution. The image forming material having a PN structure was immersed in an aqueous solution containing only 0.02 M of rose bengale. In the solution, the transparent electroconductive layer (ITO film) was utilized as a working electrode to a saturated calomel electrode. Holding the potential of the working electrode at 0.7 V, 3 mW He—Ne laser beams were applied for 10 seconds to obtain an electrodeposited thin layer, through the deposition of rose bengale on the surface of copper phthalocyanine.

The image forming material coated with this electrodeposited thin layer was brought into contact with paper containing an alkaline solution of pH 10 and as a result rose bengale was dissolved and transferred to the paper.

Example 11

As shown in FIG. 5, an image forming material provided with a a-Si sensitive member having a PIN structure was brought into contact with an aqueous solution containing pyrrole and rose bengale, and irradiated with He—Ne laser beams to form an image pattern. At this time, the image forming material was irradiated with the He—Ne laser beams while controlling the laser intensity, that is, by adjusting the intensity to a high or low value to prepare a high or low density respectively, by intensity modulation. Next, as shown in FIG. 4, the dedoping of the image forming material, on which the image pattern was formed, was performed to print an excellent image with gradation reproduction on paper.

Reference Example

Only n-type amorphous silicon (n-type a-Si) with a thickness of 1 $\mu$m was formed by vapor deposition on borosilicate glass, on which a transparent electroconductive layer of $SnO_2$ was formed by vapor deposition to prepare a reference image forming material. Using this reference image forming material, structured as shown in FIG. 6 in the same manner as in Example 1, an image forming process was carried out. As a result, no image was formed though the bias voltage was varied from 0 to 0.7 V. An image was formed at a bias voltage of 0.8 V. However, the contrast of the image was poor and hence this process was less practical than the process of the present invention.

As explained above, the present invention can provide an image forming method which forms an image of high quality, is reduced in running costs, has features of energy and resource savings, and is resistant to generation of noisy sounds and harmful substances.

Also, when the PN or PIN junction is compared with the Schottky junction with respect to photovoltaic force, the PN or PIN junction has the advantage that the resulting electromotive force is large and the voltage to be externally applied is further reduced at forming the image and, as a result, it is unnecessary to apply bias voltage depending on the material to be selected. Also, as is obvious from the fact that the PIN junction is utilized for a photodetector, the PIN junction is increased in photosensitivity and is improved in image contrast.

The image forming material utilized in such an image forming method can be large-sized and produced at low costs by using a PN junction.

What is claimed is:

1. An image forming method comprising the steps of:

preparing an image forming material provided with a substrate and a PN junction or a PIN junction formed on the surface of the substrate; and irradiating the image forming material with light to generate electromotive force, by which an image forming agent containing at least a dye is transferred to and deposited on the portion, where the electromotive force is generated, to form an image.

2. An image forming method according to claim 1, further comprising the steps of:

preparing an image forming material provided with a substrate having an electroconductive surface and a PN junction or a PIN junction formed on the electroconductive surface; and bringing a medium including a precursor of image forming agent containing at least a dye into contact with the image forming material and irradiating the image forming material with light to generate electromotive force causing the generation of a photoelectric chemical reaction in which the precursor of the image forming agent participates and to produce an image forming agent from the precursor of the image forming material, whereby the image forming agent is deposited on the portion of the image forming material, where the electromotive force is generated.

3. An image forming method according to claim 2, wherein said precursor of image forming agent includes a dye and a precursor of an electroconductive polymer;

said medium is a solution containing the precursor of the image forming agent; and the electroconductive polymer incorporating a dye molecule is produced as an image forming agent by the photo-electrochemical reaction.

4. An image forming method according to claim 2, wherein said precursor of the image forming agent includes an ion of a dye;

said medium is a solution containing the dye ion; and a molecule of the dye is produced as an image forming agent by said photo-electrochemical reaction.

5. An image forming method according to claim 2, wherein a laminating body including a substrate with an electroconductive surface and a PN junction with n-type and p-type layers laminated in this order or a PIN junction with n-type, i-type, and p-type layers laminated in this order, the PN junction or the PIN junction being formed on the electroconductive surface, is used as said image forming material;

said precursor of image forming agent includes an anionic dye and a precursor of electroconductive polymer;

said medium is a solution containing the precursor of image forming agent; and the electroconductive polymer incorporating the anionic dye is produced as an image forming agent by said photo-electrochemical reaction.

6. An image forming method according to claim 2, wherein a laminating body including a substrate with an electroconductive surface and a PN junction with p-type and n-type layers laminated in this order or a PIN junction with p-type, i-type, and n-type layers laminated in this order, the PN junction or the PIN junction being formed on the electroconductive surface, is used as said image forming material;

said precursor of image forming agent includes a cationic dye and a precursor of electroconductive polymer;

said medium is a solution containing the precursor of image forming agent; and the electroconductive polymer incorporating the cationic dye is produced as an image forming agent by said photo-electrochemical reaction.

7. An image forming method according to claim 2, wherein a laminating body including a substrate with an electroconductive surface and a PN junction with n-type and p-type layers laminated in this order or a PIN junction with n-type, i-type, and p-type layers laminated in this order, the PN junction or the PIN junction being formed on the electroconductive surface, is used as said image forming material;

said precursor of image forming agent includes an anionic dye;

said medium is a solution containing the precursor of the image forming agent; and a molecule of the dye is produced as an image forming agent by said photo-electrochemical reaction.

8. An image forming method according to claim 2, wherein a laminating body including a substrate with an electroconductive surface and a PN junction with p-type and n-type layers laminated in this order or a PIN junction with p-type, i-type, and n-type layers laminated in this order, the PN junction or the PIN junction being formed on the electroconductive surface, is used as said image forming material;

said precursor of image forming agent includes a cationic dye;

said medium is a solution containing the precursor of image forming agent; and a molecule of the dye is produced as an image forming agent by said photo-electrochemical reaction.

9. An image forming method according to claim 1, wherein, the amount of charge generated in the image forming material is varied to provide the image with gradation.

10. An image forming method according to claim 9, wherein an image is provided with gradation by applying a bias voltage to said image forming material and then altering the bias voltage.

11. An image forming method according to claim 9, wherein an image is provided with gradation by varying the intensity or irradiation time of light applied to said image forming material.

12. An image forming method according to claim 2, further comprising a step of releasing a dye from said image forming material after said image forming step and then, as required, carrying out the steps which are defined as the same steps as those in said image forming method.

13. An image forming method according to claim 2, further comprising steps of:

depositing said image forming material containing at least a dye on the surface of said PN junction or PIN junction of the image forming material without light irradiation to form a primary image, after said preparative step; and releasing a dye from the primary image formed on said image forming material as required; and carrying out said image forming method.

14. An image forming method according to claim 1, wherein a compound selected from a group consisting of phthalocyanines, porphyrins, and quinacridones is used as a p-type semiconductor of said PN or PIN junction.

15. An image forming method according to claim 1, further comprising a step of bringing a transfer medium into contact with said image forming material on which an image by said image forming agent has been formed to transfer the image formed on said image forming material to the transfer medium.

16. An image forming method according to claim 15, wherein said transfer medium containing an ion having the same polarity as the electric polarity in ionic state of said dye is bought into contact with said image forming material on which an image by said image forming agent has been formed to transfer the image formed on said image forming material to said transfer medium by ion exchange.

17. An image forming method according to claim 16, wherein said image forming agent is composed of an electroconductive polymer and a dye.

18. An image forming method according to claim 15, wherein a transfer medium with a pH adjusted to that capable of dissolving said dye is brought into contact with said image forming material on which an image formed of said image forming agent has been formed to transfer the image formed on said image forming material to said transfer medium by dissolution and diffusion.

19. An image forming method comprising the steps of:

preparing an image forming material provided with a substrate and a PN junction or a PIN junction formed on the surface of the substrate, wherein an image forming agent containing at least a dye is deposited on the surface of the junction; and irradiating the image forming material with light to generate electromotive force, by which the image forming agent is released from the portion, where the electromotive force is generated, to form an image.

20. An image forming method according to claim 19, further comprising the steps of:

preparing an image forming material provided with a substrate with an electroconductive surface and a PN junction or a PIN junction formed on the electroconductive surface, wherein an image forming agent containing at least a dye is deposited on the surface of the junction; and irradiating the image forming material with light to generate electromotive force and bringing a medium, into which at least the dye can be incorporated, into contact with the image forming material, to induce a photoelectrochemical reaction in which the image forming agent participates, whereby the image forming agent is released from the portion, where the electromotive force is generated, to form an image.

* * * * *